US011118137B2

(12) United States Patent
Ryther et al.

(10) Patent No.: US 11,118,137 B2
(45) **Date of Patent: *Sep. 14, 2021**

(54) HIGH ALKALINE CLEANERS, CLEANING SYSTEMS AND METHODS OF USE FOR CLEANING ZERO TRANS FAT SOILS

(71) Applicant: Ecolab USA Inc., Saint Paul, MN (US)

(72) Inventors: Robert J. Ryther, St. Paul, MN (US); Walter D. Cummings, Farmington, MN (US)

(73) Assignee: Ecolab USA Inc., Saint Paul, MN (US)

( * ) Notice: Subject to any disclaimer, the term of this patent is extended or adjusted under 35 U.S.C. 154(b) by 26 days.

This patent is subject to a terminal disclaimer.

(21) Appl. No.: 15/493,819

(22) Filed: Apr. 21, 2017

(65) Prior Publication Data

US 2017/0306266 A1 Oct. 26, 2017

Related U.S. Application Data

(63) Continuation of application No. 12/816,016, filed on Jun. 15, 2010.

(60) Provisional application No. 61/187,231, filed on Jun. 15, 2009.

(51) Int. Cl.

| | |
|---|---|
| ***C11D 3/00*** | (2006.01) |
| ***C11D 3/30*** | (2006.01) |
| ***C11D 3/10*** | (2006.01) |
| ***C11D 3/04*** | (2006.01) |
| ***C11D 3/06*** | (2006.01) |
| ***C11D 3/08*** | (2006.01) |
| ***C11D 7/34*** | (2006.01) |
| ***C11D 7/32*** | (2006.01) |
| ***C11D 3/37*** | (2006.01) |
| ***C11D 7/06*** | (2006.01) |
| ***C11D 3/33*** | (2006.01) |
| ***C11D 3/34*** | (2006.01) |
| ***C11D 7/16*** | (2006.01) |
| ***C11D 7/14*** | (2006.01) |

(52) U.S. Cl.

CPC ..... *C11D 3/0005* (2013.01); *C11D 3/044* (2013.01); *C11D 3/06* (2013.01); *C11D 3/08* (2013.01); *C11D 3/10* (2013.01); *C11D 3/33* (2013.01); *C11D 3/3409* (2013.01); *C11D 3/3757* (2013.01); *C11D 7/06* (2013.01); *C11D 7/14* (2013.01); *C11D 7/16* (2013.01); *C11D 7/3209* (2013.01); *C11D 7/3218* (2013.01); *C11D 7/3245* (2013.01); *C11D 7/34* (2013.01)

(58) Field of Classification Search

CPC ..... C11D 3/0005; C11D 3/044

See application file for complete search history.

(56) References Cited

U.S. PATENT DOCUMENTS

| | | | | |
|---|---|---|---|---|
| 5,811,383 | A * | 9/1998 | Klier | C11D 3/43 510/245 |
| 5,877,142 | A * | 3/1999 | Gross | C11D 1/662 510/238 |
| 5,929,007 | A | 7/1999 | Feng | |
| 7,098,178 | B2 * | 8/2006 | Gerke | A61K 8/585 510/466 |
| 7,838,484 | B2 * | 11/2010 | Underwood | C11D 3/044 510/197 |
| 2003/0119705 | A1 | 6/2003 | Barnabas et al. | |
| 2003/0143909 | A1 | 7/2003 | Barnabas et al. | |
| 2004/0072704 | A1 * | 4/2004 | Gerke | A61K 8/585 510/101 |

(Continued)

FOREIGN PATENT DOCUMENTS

| | | |
|---|---|---|
| EP | 919612 B1 | 8/1994 |
| EP | 879226 B1 | 2/1997 |

(Continued)

OTHER PUBLICATIONS

Ecolab USA Inc., PCT/IB2010/052693 filed Jun. 15, 2010, "Written Opinion of the International Searching Authority", dated Apr. 28, 2011.

(Continued)

*Primary Examiner* — Nicole M. Buie-Hatcher
*Assistant Examiner* — M. Reza-Asdjodi
(74) *Attorney, Agent, or Firm* — McKee, Voorhees & Sease, PLC

(57) ABSTRACT

The present disclosure relates to high alkaline cleaners, cleaning systems and methods for removing polymerized zero trans fat soils. The high alkaline cleaner of the present invention generally includes one or more alkaline wetting and saponifying agent(s), a chelating/sequestering system and a surface modifying-threshold agent system. In various embodiments, the cleaners may include, at least one cleaning agent comprising a surfactant or surfactant system and/or a solvent or solvent system and/or a cleaning booster such as a peroxide or sulfite type additive. The cleaners may also include one or more components to modify the composition form and/or the application method in some embodiments. All components described above may also be optimized optionally, to provide emulsification of a composition (both as a usable product or a concentrate that can be diluted to form a usable product). The use of the high alkaline cleaner of the present invention has demonstrated enhanced cleaning characteristics especially at higher temperatures (100° F. to about 300° F.) but also shows enhanced cleaning at ambient temperatures.

10 Claims, No Drawings

(56) References Cited

U.S. PATENT DOCUMENTS

2004/0121926 A1* 6/2004 Waits ..... C11D 3/0073 510/221
2004/0138084 A1 7/2004 Gohl et al.
2004/0235698 A1* 11/2004 Mercado ..... C11D 3/3958 510/238
2006/0035808 A1* 2/2006 Ahmed ..... C11D 1/40 510/499
2006/0079433 A1* 4/2006 Hecht ..... C11D 1/16 510/424
2006/0166854 A1* 7/2006 Britton ..... C11D 1/825 510/470
2006/0257281 A1* 11/2006 Weide ..... A61K 31/00 422/6
2007/0060490 A1* 3/2007 Skee ..... C11D 3/0073 510/175
2008/0188390 A1* 8/2008 Schinkel ..... C11D 7/12 510/224
2009/0288683 A1* 11/2009 Cummings ..... C11D 11/0023 134/19
2009/0325842 A1* 12/2009 DeDominicis ..... C11D 1/66 510/238
2010/0317559 A1* 12/2010 Ryther ..... C11D 3/044 510/218
2010/0317560 A1* 12/2010 Ryther ..... C11D 3/044 510/218

FOREIGN PATENT DOCUMENTS

EP 981597 B1 4/1998
EP 981597 B2 4/1998
EP 1583813 B1 1/2004
JP 2004536198 A 12/2004
WO 0208374 A1 1/2002
WO 03044151 A1 5/2003
WO 2008008063 A1 1/2008
WO WO-2009141742 A2 * 11/2009 ..... C11D 3/3942

OTHER PUBLICATIONS

Ecolab USA Inc., PCT/IB2010/052693 filed Jun. 15, 2010, "PCT International Search Report", dated Apr. 28, 2011.

* cited by examiner

HIGH ALKALINE CLEANERS, CLEANING SYSTEMS AND METHODS OF USE FOR CLEANING ZERO TRANS FAT SOILS

CROSS-REFERENCE TO RELATED APPLICATIONS

This application is a Continuation of U.S. Ser. No. 12/816,016, filed Jun. 15, 2010, which claims priority under 35 U.S.C. § 119 to Provisional Application Ser. No. 61/187,231, filed Jun. 15, 2009. The entire contents of which are hereby expressly incorporated by reference in its entirety including, without limitation, the specification, claims, and abstract, as well as any figures, tables, or drawings thereof.

FIELD OF THE INVENTION

The present disclosure relates to high alkaline cleaners, cleaning systems and methods for removing polymerized zero trans fat soils. The high alkaline cleaner of the present invention generally includes one or more alkaline wetting and saponifying agent(s), a chelating/sequestering system and a surface modifying-threshold agent system. The high alkaline cleaner may also include, at least one cleaning agent comprising a surfactant or surfactant system and/or a solvent or solvent system and/or a cleaning booster such as a peroxide or sulfite type additive. In various embodiments, the cleaners may include one or more additives to modify the composition form and/or the application method. AH components described above may also be optimized optionally, to provide emulsification of a composition at a usable cleaning solutions concentration or in a concentrated form that may be diluted to a usable cleaning solution concentration. The use of the high alkaline cleaner of the present invention has demonstrated enhanced cleaning characteristics especially at higher temperatures (100° F. to about 200° F.) but also shows enhanced cleaning at ambient temperatures in comparison to other conventional cleaning techniques.

BACKGROUND

Health authorities have recently recommended that trans fats be reduced in diets because they present health risks. In response, the food industry has largely replaced the use of trans fats with zero trans fats. Trans fats being defined as unsaturated fat with trans-isomer fatty acid(s). Food products with zero trans fat is defined by the United States Food and Drug Administration in the regulation 21 CFR 101.9 (c)(2)(ii) to "contain less than 0.5 grams of total fat in a serving" and that "trans fat content information is not required for products that contain less than 0.5 grams of total fat in a serving" and "if the serving contains less than 0.5 grams of total fat, the content, when declared, shall be expressed as zero." Manufacturers desiring a level of fat in food products higher than 0.5 grams (adjusted for the level of trans fat in a given fat used in the food product) per serving are required to use fats with low trans fat content or zero trans fats. (Fats defined as zero trans fats by those skilled in the art will generally, by the nature of the processing required for these fats, contain relatively small amounts of trans fats.) While the use of zero trans fats in food products is good for consumers, it is problematic for the food industry, because food processing equipment and/or environmental surfaces become contaminated with polymerized zero trans fat soils, which are very difficult to clean. Zero trans fats are less stable and more prone to degradation and polymerization than trans fat or saturated fats. Zero trans fats can be left on ambient or cold surfaces for an extended period of time and polymerize on these surfaces creating a difficult to clean soil. The longer a zero trans fat soil is left to polymerize on a surface, the more difficult it becomes to remove the soil from that surface. Mists of zero trans fats emanating from a hot zero trans fat source can also collect onto various surfaces and polymerize over time on these surfaces. The surfaces collecting these mists can be at cold, hot or ambient temperatures and create difficult to clean soils on all of these surfaces. Zero trans fats can be burnt onto cooking surfaces and then polymerize over time at an increased rate compared to a surface at a lower temperature and create soils that are more difficult to remove than similarly produced trans fat or saturated fat based soils. In addition, other food materials such as proteins, carbohydrates and other fats can be mixed in with the zero trans fats which, as they polymerize can also create complicated, harder to remove soils and residues than if the soils did not contain polymerized zero trans fat soils.

Those employing frying and baking operations are particularly affected by zero trans fat soils, because they use zero trans fats in high volumes. Also, these operations commonly route zero trans fats through tanks, lines, pumps and other processing equipment, which must be periodically cleaned but can in some operations go a significant amount of time between cleanings as required by the specific production process. In addition, other equipment, especially high, out of place piping, duct work (external as well as internal), roofs and ceilings, heating, cooling and air conditioning surfaces (HVAC), product freezers and coolers and many other surfaces in food manufacturing sites, can sometimes be left for days, weeks or months without thorough cleaning, collecting zero trans fat contamination and forming extremely hard to remove, polymerized zero trans fat soils. These soils can be so difficult to remove that in some cases, it would be less expensive to replace equipment than to pay for the intensive labor required to dean the surfaces properly. In order to permit food production operations to continue without major changes to equipment and food processing facility designs, a new method of cleaning is needed to permit extended food production time and to retain a safe, clean food processing environment.

Therefore, it would be desirable to provide a cleaning composition that can disrupt the structure of polymerized zero trans fat soils to adequately remove this type of soil and thereby clean surfaces. It would also be desirable to provide cleaning systems and methods to remove polymerized zero trans fat soils, particularly soils that are on hard to access equipment.

SUMMARY OF THE INVENTION

In one embodiment, the present invention is a method of cleaning polymerized zero trans fat soils from soiled surfaces using a high alkaline-solvent composition including one or more alkaline wetting and saponifying agents, a chelating/sequestering system and a surface modifying-threshold agent system. The method includes forming a composition and contacting a soiled surface with the composition.

In another embodiment, the present invention is a high-alkaline solvent composition including between about 1 wt. % to about 20 wt. % of alkaline wetting and saponifying agent(s), between about 0.1 wt. % to about 15 wt. % of a chelating/sequestering system and between about 0.5 wt. % to about 30 wt. % of a surface modifying threshold agent system. The composition may include between about 0.1 wt. % to about 20 wt. % one or more cleaning agent(s) including a surfactant or surfactant system and/or a solvent or solvent system and/or a cleaning booster. The composition may also include between about 0.01 wt. % to about 5 wt. % of one or more additive(s) to modify the composition form and/or the application method. Moreover, the composition may be emulsified at a usable cleaning solution concentration or in a concentrated form that may be diluted to a usable cleaning solution concentration.

DETAILED DESCRIPTION

The present invention relates to high alkaline-solvent cleaning compositions, cleaning systems and cleaning methods for removing polymerized zero trans fat soils from a soiled surface, which are more difficult to clean than surfaces with trans fat soils.

So that the invention may be more readily understood, certain terms are first defined.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, the term "cleaning" refers to a method used to facilitate or aid in soil removal, bleaching, microbial population reduction, and any combination thereof.

High-Alkaline Solvent Composition

The present invention relates to high alkaline compositions that clean polymerized zero trans fat soils. In many embodiments of the present invention, the high alkaline compositions are beneficial in cleaning soiled surfaces, wherein the soils include polymerized zero trans fat soils. Generally, the high alkaline composition includes: one or more alkaline wetting and saponifying agent(s), a chelating/sequestering system and a surface modifying-threshold agent system. In some embodiments of the present invention, the cleaners may include, at least one cleaning agent comprising a surfactant or surfactant system and/or a solvent or solvent system and/or a cleaning booster. In other embodiments of the present invention, the cleaners may include, one or more additives to modify the composition form and/or the application method. All components described above can also be optimized optionally, to provide emulsification of a composition at a usable cleaning solutions concentration or in a concentrated form that may be diluted to a usable cleaning solution concentration. In addition, the efficacy of the cleaning of the polymerized zero trans fat soils is generally enhanced with increased temperature of the cleaning solution. The use of the high alkaline cleaner of the present invention has demonstrated enhanced cleaning characteristics especially at higher temperatures (100° F. to about 200° F.).

Not intended to be bound by theory, there is evidence that these zero trans fats polymerize more readily in the presence of unsaturated fatty acids formed as a fat decomposition product, as well as evidence that heavier metal salts (such as calcium, magnesium, iron etc.), introduced through hard water, other food ingredients or residue from food processing equipment, also can increase polymerization rates. Again, not intending to be bound by theory, the fatty acids can form salts with metal cations within the polymerized soil and while appearing to accelerate the polymerization of the soil, also appear to provide sites within the polymer that once removed, can support the breaking up of the polymerized zero trans fat soil. The cleaning formulas, therefore, have been optimized with components that are known to clean both the oily soils as well as polar, heavier metal containing soils such as the fatty acid salts. This combination of cleaning components appears to support the break down of the polymeric nature of these soils so they can be removed from the surface to be cleaned.

Additionally, the combination of high alkalinity, which permits some wetting and/or breaking down through saponifying of the oily portion of the polymerized zero trans fat soil in addition to being a cation source to support the break down of the heavier metal fatty acid salts in the polymerized soil, the presence of effective chelant to support the removal of heavier metal cations in fatty acid salts in the polymerized soil on the surface being cleaned, a surface modifying-threshold system that minimizes soil redeposition and, in some embodiments of the present invention, the presence of at least one cleaning agent comprising one or more surfactants to both support the wetting and emulsification of the oily components portions of the polymerized zero trans fat soil, create together a system that can break down and remove the polymerized zero trans fat soil from soiled surfaces. It is noted that the addition of one or more cleaning enhancement components can be beneficial for particular cleaning needs comprising cleaning additives such as peroxygen based compounds or sulfite based compounds that work in conjunction with alkalinity to enhance the cleaning of polymerized zero trans fat soils and the use of modifiers, such a thickeners and/or foaming agents affect the form of the product, which often needs to be adjusted based on the soiled surface to be cleaned. All components described above can also be optimized optionally, to provide emulsification of a composition (both as a usable product or a concentrate that can be diluted to form a usable product).

Alkaline Wetting and Saponifying Agent(s)

The present invention also relates to a high alkaline composition which includes one or more alkaline wetting and saponifying agent(s). The removal of soils including polymerized zero trans fats must be initiated and sustained by the penetration and disruption of these fats from the upper soil surface all the way to the substrate surface being cleaned. Such a breakdown of these fats allows the chelating/sequestering agent(s), the surface modifying-threshold agent system and, in various embodiments, the cleaning agent(s) of the composition to penetrate the soils and interact with the polymerized fat molecules and remove these soils from the substrate or surface to be cleaned. For example, the cations of the alkaline (e.g. $Na^+$, $K^+$ . . . ) will saponify a fat by reaction with the ester bond in the fat, forming a fatty acid salt. This reaction will start opening up or wetting the polymerized soil. Key features of the polymerized zero trans fat soil appear to be free fatty acids formed by the break down of the fats which can polymerize at unsaturation sites and, in addition can also form water insoluble salts with heavier metal cations (such as $Ca^{2+}$, $Mg^{2+}$ or other metal cations from hard water or food components). While normal fat soils (trans fat oils, animal based fats, non-polymerized zero trans fat oils) are easily removed with low alkalinity and an emulsifying agent, the combination of high alkalinity to open up or wet the soils and agents normally effective for chelating/sequestering and inhibiting redeposition of metal cations appear to support the break down of these polymerized zero trans fat soils. In many embodiments of the present invention the pH of the cleaner is about 11 or greater. In other embodiments of the present invention the pH of the cleaning composition is about 12 or greater. In still other embodiments of the present invention the pH of the cleaning composition is about 13 or greater.

Examples of suitable alkaline sources include basic salts, amines, alkanol amines, carbonates and silicates. Particularly preferred alkaline sources include alkali or alkaline earth metal hydroxides.

In some embodiments, the source of alkalinity comprises an alkali or alkaline earth metal hydroxide, for example, sodium hydroxide (NaOH), lithium hydroxide, calcium hydroxide, and/or potassium hydroxide (KOH). Other alkalinity sources suitable for use in the compositions and methods of the present invention include, but are not limited to, silicate salts, amines, alkanol amines, phosphate salts, polyphosphate salts, carbonate salts, borate salts, and combinations thereof. For example, the source of alkalinity can comprise sodium silicate, sodium metasilicate, sodium orthosilicate, sodium phosphate, sodium polyphosphate, sodium borate, sodium carbonate, potassium silicate, potassium metasilicate, potassium orthosilicate, potassium phosphate, potassium polyphosphate, potassium borate, potassium carbonate, lithium silicate, lithium metasilicate, lithium orthosilicate, lithium phosphate, lithium polyphosphate, lithium borate, lithium carbonate, 2-(2-aminoethoxy) ethanol, monoethanolamine, diethanolamine, triethanolamine, mixed isopropanolamines, morpholine, n,n-dimethyl ethanolamine and combinations thereof.

In some embodiments, the cleaning compositions of the present invention comprise about 0.1 wt % to about 75 wt % of a source of alkalinity. In some embodiments, the source of alkalinity is present at about 1 wt % to about 40 wt % of the cleaning composition. In still yet other embodiments, the cleaning compositions comprise about 1.5% to about 30 wt % of a source of alkalinity. It is to be understood that all values and ranges between these values and ranges are encompassed by the present invention.

Chelating/Sequestering Agent(s)

The present invention is a high alkaline composition which also includes one or more chelating/sequestering agent(s) to complex metal cation contained in the polymerized zero trans fat soils. Exemplary commercially available chelating/sequestering agent(s) include, but are not limited to: sodium gluconate (e.g. granular) and sodium tripolyphosphate (available from Innophos); Trilon A® available from BASF; Versene 100®, Low NTA Versene®, Versene Powder®, and Versenol 120® all available from Dow; Dissolvine D-40 available from BASF; and sodium citrate.

In some embodiments, an organic chelating/sequestering agent(s) can be used. Organic chelating/sequestering agent(s) include both polymeric and small molecule chelating/sequestering agent(s). Organic small molecule chelating/sequestering agent(s) are typically organocarboxylate compounds or organophosphate chelating/sequestering agent(s). Polymeric chelating/sequestering agent(s) commonly include polyanionic compositions such as polyacrylic acid compounds. Small molecule organic chelating/sequestering agent(s) include N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid triethylenetetraaminehexaacetic acid (TTHA), and the respective alkali metal, ammonium and substituted ammonium salts thereof. Aminophosphonates are also suitable tor use as chelating/sequestering agent(s) and include ethylenediaminetetramethylene phosphonates, nitrilotrismethylene phosphonates, and diethylenetriamine-(pentamethylene phosphonate) for example. These aminophosphonates commonly contain alkyl or alkenyl groups with less than 8 carbon atoms.

Other suitable chelating/sequestering agent(s) include water soluble polycarboxylate polymers. Such homopolymeric and copolymeric chelating/sequestering agent(s) include polymeric compositions with pendant (—$CO_2H$) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers or copolymers such as their respective alkali metal (for example, sodium or potassium) or ammonium salts can also be used. The weight average molecular weight of the polymers is from about 4000 to about 12,000.

In some embodiments, the amount of chelating/sequestering agent(s) present in the composition is about 0.1 wt % to about 15 wt %. In other embodiments, the amount of chelating/sequestering agent(s) present in the composition is about 0.5 wt % to about 5 wt %. In still other embodiments, the amount of chelating/sequestering agent(s) present in the composition is about 0.5% wt % to about 3 wt %.

Surface Modifying-Threshold Agents

The present invention is a high alkaline composition which also includes one or more surface modifying-threshold agent(s). The surface modifying-threshold agent(s) of the present invention in addition to providing the well known corrosion inhibition of silicate compounds in alkaline media on soft metal surfaces has also been observed to provide threshold inhibition of soil redeposit ion when a silicate compound is used in conjunction with polyacrylate additives In the current composition, a synergistic relationship between a silicate and a polyacrylate is observed to support a "synergistic" effect using these materials with respect to (1) viscosity control and (2) viscosity stability with time at ambient and elevated temperatures. Moreover, the inorganic salts such as a clay are well dispersed in an aqueous solution providing a threshold effect (anti-redeposition of soil on a surface being cleaned) of charged species in the polymerized zero trans fat soil.

Exemplary commercially available surface modifying agents include, but are not limited to: sodium silicate, sodium metasilicate, sodium orthosilicate, potassium silicate, potassium metasilicate, potassium orthosilicate, lithium silicate, lithium metasilicate, lithium orthosilicate, aluminosilicates and other alkali metal salts and ammonium salts of silicates. Exemplary commercially available acrylic type polymers include acrylic acid polymers, methacrylic acid polymers, acrylic acid-methacrylic acid copolymers, and water-soluble salts of the said polymers. These include polyelectrolytes such as water soluble acrylic polymers such as polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, hydrolyzed methacrylamide, hydrolyzed acrylamide-methacrylamide copolymers, and combinations thereof. Such polymers, or mixtures thereof, include water soluble salts or partial salts of these polymers such as their respective alkali metal (for example, sodium or potassium) or ammonium salts can also be used. The weight average molecular weight of the polymers is from about 2000 to about 20,000.

In some embodiments, the amount of surface modifying-threshold agents present in the composition is about 0.1 wt % to about 30 wt % silicate species and about 0.01 wt % to about 10 wt % acrylic polymer. In other embodiments, the amount of surface modifying agents present in the composition is about 0.1 wt % to about 15 wt % silicate species and about 0.01 wt % to about 5 wt % acrylic polymer. In other embodiments, the amount of chelating/sequestering agent(s) present in the composition is about 0.1 wt % to about 5 wt % silicate species and about 0.1 wt % to about 2 wt % acrylic polymer.

Cleaning Agent(s)—Surfactant or Surfactant System

In various embodiments of the present invention, the high alkaline composition may include at least one cleaning agent comprising a surfactant or surfactant system. The surfactant or surfactant system is used to help emulsify the zero trans fats soil in the alkaline cleaning solution as well as work in conjunction with the alkaline fatty acid soaps that are formed naturally as a result of the breaking down of zero trans fats in the alkaline cleaning solution. Cleaning agent(s) may also be used to provide emulsifying properties of a given composition (to keep hydrophilic and hydrophobic components of the specific composition from separating) if required for a polymerized zero trans fat soil cleaning method. The emulsifying properties can be used for both a concentrate that can be diluted to create a usable cleaning product (use dilution) and the use dilution itself. The surfactant or mixture of surfactants can have foaming or defoaming characteristics in the composition as required by a desired cleaning method. For example, in certain applications a long lasting foam may be required which can extend the cleaning time on a surface for the compositions. In certain applications it may be desirable to minimize foaming and a surfactant or surfactant system that provides reduced foaming can be used. In addition, it may be desirable to select a surfactant or surfactant system that exhibits a foam that breaks down relatively quickly so that the composition can be recovered and reused with an acceptable amount of down time. The surfactant or surfactant system can be selected depending upon the particular polymerized zero trans fat soil that is to be removed. Surfactants that can be used in the system include anionic, nonionic, cationic, and zwitterionic surfactants, which are commercially available from a number of sources. Suitable surfactants include nonionic surfactants, for example, low foaming nonionic surfactants. For a discussion of surfactants, see Kirk-Othmer, *Encyclopedia of Chemical Technology*, Third Edition, volume 8, pages 900-912.

It should be understood that surfactants are an optional component of the compositions and can be included in some embodiments or excluded from the compositions in other embodiments.

In some embodiments, the cleaning compositions of the present invention comprise about 0.1 wt % to about 40 wt % of a surfactant or surfactant system as a cleaning agent. In some embodiments, the cleaning agent is present in the composition at about 0.2 wt % to about 15 wt %. In still yet oilier embodiments, the cleaning agent is present in the compositions at about 0.5% to about 10 wt %. It is to be understood that all values and ranges between these values and ranges are encompassed by the present invention.

Suitable nonionic surfactants include, but are not limited to, those having a polyalkylene oxide polymer as a portion of the surfactant molecule. Exemplary nonionic surfactants include, but are not limited to, chlorine-, benzyl-, methyl-, ethyl-, propyl-, butyl- and other like alkyl-capped polyethylene and/or polypropylene glycol ethers of fatty alcohols; polyalkylene oxide free nonionics such as alkyl polyglycosides; sorbitan and sucrose esters and their ethoxylates; alkoxylated ethylene diamine; carboxylic acid esters such as glycerol esters, polyoxyethylene esters, ethoxylated and glycol esters of fatty acids; carboxylic amides such as diethanol amine condensates, monoalkanolamine condensates, polyoxyethylene fatty acid amides; and ethoxylated amines and ether amines commercially available from Tomah Corporation and other like nonionic compounds. Silicone surfactants such as the ABIL B8852 (Goldschmidt) can also be used.

Additional exemplary nonionic surfactants include, but are not limited to, those having a polyalkylene oxide polymer portion include nonionic surfactants of C6-C24 alcohol ethoxylates (e.g., C6-C14 alcohol ethoxylates) having 1 to about 20 ethylene oxide groups (e.g., about 9 to about 20 ethylene oxide groups); C6-C24 alkylphenol ethoxylates (e.g., C8-C10 alkylphenol ethoxylates) having 1 to about 100 ethylene oxide groups (e.g., about 12 to about 20 ethylene oxide groups); C6-C24 alkylpolyglycosides (e.g., C6-C20 alkylpolyglycosides) having 1 to about 20 glycoside groups (e.g., about 9 to about 20 glycoside groups); C6-C24 fatty acid ester ethoxylates, propoxylates or glycerides; and C4-C24 mono or dialkanolamides.

Exemplary alcohol alkoxylates include, but are not limited to, alcohol, ethoxylate propoxylates, alcohol propoxylates, alcohol propoxylate ethoxylate propoxylates, alcohol ethoxylate butoxylates; nonylphenol ethoxylate, polyoxyethylene glycol ethers; and polyalkylene oxide block copolymers including an ethylene oxide/propylene oxide block copolymer such as those commercially available under the trademark PLURONIC (BASF-Wyandotte).

Examples of suitable low foaming nonionic surfactants also include, but are not limited to, secondary ethoxylates, such as those sold under the trade name TERGITOL™, such as TERGITOL™ 15-S-7 (Union Carbide), Tergitol 15-S-3, Tergitol 15-S-9 and the like. Other suitable classes of low foaming nonionic surfactants include alkyl or benzyl-capped polyoxyalkylene derivatives and polyoxyethylene/polyoxypropylene copolymers.

An additional useful nonionic surfactant is nonylphenol having an average of 12 moles of ethylene oxide condensed thereon, it being end capped with a hydrophobic portion including an average of 30 moles of propylene oxide.

Silicon-containing defoamers are also well-known and can be employed in the methods of the present invention.

Suitable amphoteric surfactants include, but are not limited to, amine oxide compounds having the formula:

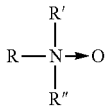

where R, R', R", and R'" are each a $C_1$-$C_{24}$ alkyl, aryl or arylalkyl group that can optionally contain one or more P, O, S or N heteroatoms.

Another class of suitable amphoteric surfactants includes betaine compounds having the formula:

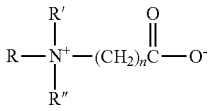

where R, R', R" and R'" are each a $C_1$-$C_{24}$ alkyl, aryl or aralkyl group that can optionally contain one or more P, O, S or N heteroatoms, and n is about 1 to about 10.

Suitable surfactants may also include food grade surfactants, linear alkylbenzene sulfonic acids and their salts, and ethylene oxide/propylene oxide derivatives sold under the Pluronic™ trade name. Suitable surfactants include those that are compatible as an indirect or direct food additive or substance.

Suitable anionic surfactants include, but are not limited to, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionics include, but are not limited to, sodium alkylarylsulfonate, alpha-olefin sulfonate, and fatty alcohol sulfates. Examples of suitable anionic surfactants include sodium dodecylbenzene sulfonic acid, potassium laureth-7 sulfate, and sodium tetradecenyl sulfonate.

In some embodiments, the surfactant includes linear alkyl benzene sulfonates, alcohol sulfonates, alkyl diphenylether disulfonates, amine oxides, linear and branched alcohol ethoxylates, alkyl polyglucosides, alkyl phenol ethoxylates, polyethylene glycol esters, EO/PO block copolymers and combinations thereof.

The surfactants described herein can be used singly or in combination. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. It should be understood that the selection of particular surfactants or combinations of surfactants can be based on a number of factors including compatibility with the surface to be cleaned at the intended use concentration and the intended environmental conditions including temperature and pH.

In addition, the level and degree of foaming under the conditions of use and in subsequent recovery of the composition can be a factor for selecting particular surfactants and mixtures of surfactants.

Cleaning Agent(s)—Solvent System

In various embodiments of the present invention, the high alkaline composition may include at least one cleaning agent comprising a solvent or solvent system. The solvent or solvent system can be used as for enhancing the cleaning and the soil wetting properties of the high alkaline composition as well as to provide emulsifying properties of a given composition (to keep hydrophilic and hydrophobic components of the specific composition from separating) if required for a polymerized zero trans fat soil cleaning method. The emulsifying properties can be used for both a concentrate that can be diluted to create a usable cleaning product (use dilution) and the use dilution itself.

Representative solvent systems generally comprise one or more different solvents including aromatic alcohols (e.g., benzyl alcohols, phenyl alcohols), alkanol amines, ether amines, esters (e.g., cyclic esters, dibasic esters and phthalate esters, methyl esters, butyl esters . . . ) and mixtures thereof. Representative solvents include acetamidophenol, acetanilide, acetophenone, 2-acetyl-1-methylpyrrole, benzyl acetate, benzyl alcohol methyl benzyl alcohol, alpha phenyl ethanol, benzyl benzoate, benzyloxyethanol, ethylene glycol phenyl ether (commercially available as "DOWANOL EPh" from Dow Chemical Co.), propylene glycol phenyl ether (commercially available as "DOWANOL PPh" from Dow Chemical Co.), amyl acetate, amyl alcohol, butanol, 3-butoxyethyl-2-propanol, butyl acetate, n-butyl propionate, cyclohexanone, diacetone alcohol, diethoxyethanol, diethylene glycol methyl ether, diisobutyl carbinol, diisobutyl ketone, dimethyl heptanol, dipropylene glycol tert-butyl ether, ethanol, ethyl acetate, 2-ethylhexanol, ethyl propionate, ethylene glycol methyl ether acetate, hexanol, isobutanol, isobutyl acetate, isobutyl heptyl ketone, isophorone, isopropanol, isopropyl acetate, methanol, methyl amyl alcohol, methyl n-amyl ketone, 2-methyl-1-butanol, methyl ethyl ketone, methyl isobutyl ketone, 1-pentanol, n-pentyl propionate, 1-propanol, n-propyl acetate, n-propyl propionate, propylene glycol ethyl ether, tripropylene glycol methyl ether (commercially available as DOWANOL TPM from Dow Chemical Co.), tripropylene glycol n-butyl ether (commercially available as DOWANOL TPNB from Dow Chemical Co.), diethylene glycol n-butyl ether acetate (commercially available as Butyl CARBITOL™ acetate from Dow Chemical Co.), diethylene glycol monobutyl ether (commercially available as Butyl CARBITOL from Dow Chemical Co.), ethylene glycol n-butyl ether acetate (commercially available as Butyl CELLOSOLVE™ acetate from Dow Chemical Co.), ethylene glycol monobutyl ether (commercially available as Butyl CELLOSOLVE from Dow Chemical Co.), dipropylene glycol monobutyl ether (commercially available as Butyl DIPROPASOL™ from Dow Chemical Co.), propylene glycol monobutyl ether (commercially available as Butyl PROPASOL from Dow Chemical Co.), ethyl 3-ethoxypropionate (commercially available as UCAR™ Ester EEP from Dow Chemical Co.), 2,2,4-Trimethyl-1,3-Pentanediol Monoisobutyrate (commercially available as UCAR Filmer IBT from Dow Chemical Co.), diethylene glycol monohexyl ether (commercially available as Hexyl CARBITOL from Dow Chemical Co.), ethylene glycol monohexyl ether (commercially available as Hexyl CELLOSOLVE from Dow Chemical Co.), diethylene glycol monomethyl ether (commercially available as Methyl CARBITOL from Dow Chemical Co.), diethylene glycol mono-ethyl ether (commercially available as CARBITOL from Dow Chemical Co.), ethylene glycol methyl ether acetate (commercially available as Methyl CELLOSOLVE acetate from Dow Chemical Co.), ethylene glycol monomethyl ether (commercially available as Methyl CELLOSOLVE from Dow Chemical Co.), dipropylene glycol monomethyl ether (commercially available as Methyl DIPROPASOL from Dow Chemical Co.), propylene glycol methyl ether acetate (commercially available as Methyl PROPASOL™ acetate from Dow Chemical Co.), propylene glycol monomethyl ether (commercially available as Methyl PROPASOL from Dow Chemical Co.), diethylene glycol monopropyl ether (commercially available as Propyl CARBITOL from Dow Chemical Co.), ethylene glycol monopropyl ether (commercially available as Propyl CELLOSOLVE from Dow Chemical Co.), dipropylene glycol monopropyl ether (commercially available as Propyl DIPROPASOL from Dow Chemical Co.) and propylene glycol monopropyl ether (commercially available as Propyl PROPASOL from Dow Chemical Co.). Representative dialkyl carbonates include dimethyl carbonate, diethyl carbonate, dipropyl carbonate, diisopropyl carbonate and dibutyl carbonate. Representative oils include benzaldehyde, pinenes (alphas, betas, etc.), terpineols, terpinenes, carvone, cinnamealdehyde, borneol and its esters, citrate, ionenes, jasmine oil, limonene, dipentene, linalool and its esters. Representative dibasic esters include dimethyl adipate, dimethyl succinate, dimethyl glutarate, dimethyl malonate, diethyl adipate, diethyl succinate, diethyl glutarate, dibutyl succinate, dibutyl glutarate and products available under the trade designations DBE.TM, DBE-3, DBE-4, DBE-5, DBE-6, DBE-9, DBE-IB, and DBE-ME from DuPont Nylon. Representative phthalate esters include dibutyl phthalate, diethylhexyl phthalate and diethyl phthalate. Preferred solvents for wetting of polymerized non-trans fat soils include benzyl alcohol, dibasic esters, essential oils, dialkyl carbonates, ethylene glycol monobutyl ether, diethylene glycol monobutyl ether, ethylene glycol phenyl ether, propylene glycol phenyl ether and mixtures thereof. Representative alkanol amines include 2-(2-aminoethoxy)ethanol, monoethanolamine, diethanolamine, triethanolamine, mixed isopropanolamines, morpholine, n,n-dimethyl ethanolamine and mixtures thereof.

In some embodiments, the amount of solvent(s) present in the composition is about 0.1 wt % to about 50 wt %. In other embodiments, the amount of solvent(s) present in the composition is about 1 wt % to about 40 wt %. In still other embodiments, the amount of solvent(s) present in the composition is about 2 wt % to about 20 wt %.

Cleaning Agent(s)—Peroxygen and Sulfite Additive Cleaning Boosters

In some embodiments of the present invention, the high alkaline composition may also include at least one cleaning agent comprising a peroxygen or sulfite additive based booster. These components are considered unstable for long periods of time in alkaline solutions and, not to be bound by theory, most likely form radical species in the alkaline media that enhance breakdown of the polymerized zero trans fat soils. These components are generally added during the cleaning cycle and not stored for any significant length of time as they will lose their efficacy in alkaline media.

In some embodiments, the sulfite sources are water soluble salts of sulfite ion ($SO_3^{-2}$), bisulfite ion ($HSO_3^-$), meta bisulfite ion ($S_2O_5^{-2}$) and hydrosulfite ion ($S_2O_4^{-2}$) and mixtures thereof. In some embodiments, the amount of alkaline sulfite source included in the cleaning composition is about 0.01 wt-% to about 10 wt-% of the cleaning composition. Acceptable levels of alkaline sulfite source present are about 0.05 to about 2.5 wt-%. It is to be understood that all values and ranges between these values and ranges are encompassed by the present invention.

In some embodiments, the peroxygen compound is an active oxygen source. Peroxygen compounds, including, but not limited to, hydrogen peroxide, peroxides and various percarboxylic acids, including percarbonates can be used with the methods of the present invention. Peroxycarboxylic (or percarboxylic) acids generally have the formula R(CO3H)n, where, tor example, R is an alkyl, arylalkyl, cycloalkyl, aromatic, or heterocyclic group, and n is one, two, or three, and named by prefixing the parent acid with peroxy. The R group can be saturated or unsaturated as well as substituted or unsubstituted. Medium chain peroxycarboxylic (or percarboxylic) acids can have the formula R(CO3H)n, where R is a C5-C11 alkyl group, a C5-C11 cycloalkyl, a C5-C11 arylalkyl group, C5-C11 aryl group, or a C5-C11 heterocyclic group; and n is one, two, or three. Short chain peroxycarboxylic acids can have the formula R(CO3H)n where R is C1-C4 and n is one, two, or three. Exemplary peroxycarboxylic acids for use with the present invention include, but are not limited to, peroxypentanoic, peroxyheptanoic, peroxyheptanoic, peroxyoctanoic, peroxynonanoic, peroxyisononanoic, peroxydecanoic, peroxyundecanoic, peroxydodecanoic, peroxyascorbic, peroxyadipic, peroxycitric, peroxypimelic, or peroxysuberic acid, mixtures thereof, or the like.

Branched chain peroxycarboxylic acids include peroxyisopentanoic, peroxyisononanoic, peroxyisohexanoic, peroxyisoheptanoic, peroxyisooctanoic, peroxyisonananoic, peroxyisodecanoic, peroxyisoundecanoic, peroxyisododecanoic, peroxyneopentanoic, peroxyneohexanoic, peroxyneoheptanoic, peroxyneooctanoic, peroxyneononanoic, peroxyneodecanoic, peroxyneoundecanoic, peroxyneododecanoic, mixtures thereof, or the like.

Additional exemplary peroxygen compounds for use with the methods of the present invention, include hydrogen peroxide (H2O2), peracetic acid, peroctanoic acid, a persulphate, a perborate, or a percarbonate. In some embodiments, the active oxygen use solution cleaning composition comprises at least two, at least three, or at least four active oxygen sources. In other embodiments, the cleaning composition can include multiple active oxygen sources, for example, active oxygen sources that have a broad carbon chain length distribution. In still yet other embodiments, for example, combinations of active oxygen sources for use with the methods of the present invention can include, but are not limited to, peroxide/peracid combinations, and peracid/peracid combinations. In other embodiments, the active oxygen use solution comprises a peroxide/acid or a peracid/acid composition.

The amount of active oxygen source in the active oxygen cleaning composition is dependent on a variety of factors including, for example, the type of surface to be cleaned, and the amount and type of soil present on the surface. In some embodiments, the amount of active oxygen source included in the cleaning composition is about 0.01 wt-% to about 10 wt-% of the cleaning composition. Acceptable levels of active oxygen source present are about 0.5 to about 2.5 wt-%. It is to be understood that all values and ranges between these values and ranges are encompassed by the present invention.

Thickening Agents

One or more thickening agents may also be provided in some embodiments of the present composition to enhance residence time on the substrate surface to be cleaned and assist in keeping the other components together (e.g. the wetting agents and alkaline agents) to further support cleaning. Suitable thickening agents include, but are not limited to, natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays; and finely divided fumed or precipitated silica, to list a few. The thickening agent may also be used to provide emulsifying properties of a given composition (to keep hydrophilic and hydrophobic components of the specific composition from separating) if required for a polymerized zero trans fat soil cleaning method. The emulsifying properties can be used for both a concentrate that can be diluted to create a usable cleaning product (use dilution) and the use dilution itself.

In some embodiments, the thickener is present in the composition at about 0.01 wt % to about 5 wt %. In still yet other embodiments, the thickener is present in the compositions at about 0.1% to about 2 wt %. It is to be understood that all values and ranges between these values and ranges are encompassed by the present invention.

Diluent(s)

The composition of the present invention can be formulated in a concentrated form which then may be diluted to the desired concentration merely with water at the intended use location. Ordinary tap water, softened water or process water may be employed. The composition concentrates and various dilutions of these concentrates (typically can be used at full strength concentrate down to a 1:100 concentrate: water dilution) can be used on polymerized zero trans fat soils of various difficulties. (A more difficult to remove polymerized zero trans fat soil will generally have a higher level of polymerization.) A variety of mixing methods may be employed (such as automated or manual dilutions) and various levels of additives, such as thickening agents, can be mixed in with the diluted composition depending on the specific needs of the cleaning operation.

Examples-Compositions

The following Tables 1-8 illustrate exemplary high alkaline compositions. Tables 2, 4, 6 and 8 illustrate variations that are more suitable for use on soft metal surfaces as they contain an increased level of sodium silicate relative to sodium hydroxide. The higher level of silicate provides greater protection from corrosion in high alkaline environments for soft metal surfaces (such as aluminum). These solutions work well on surfaces where concern tor protection against corrosion of soft metal is important. This soft metal safe variation can be used for cleaning of non-stainless steel or other soft metal surfaces.

Tables 1-2 illustrate a basic high alkaline composition, which includes an alkaline source, a silicate source to enhance cleaning and provide threshold inhibition in conjunction with the polyacrylate as well as provide some soft metal corrosion protection, a surfactant system to provide soil wetting and a chelant mixture.

TABLE 1

| Alkaline Solution | |
|---|---|
| Weight % | Ingredient |
| 95.6 | Water, Zeolite Softened |
| 0.2 | Tetrasodium EDTA 40% |
| 0.2 | Sodium Gluconate Granular |

TABLE 1-continued

| Alkaline Solution | |
|---|---|
| Weight % | Ingredient |
| 0.1 | Sodium Silicate Solution, 2.40 $SiO_2/Na_2O$ |
| 0.2 | Accusol 448 |
| 0.4 | Glucopon 425N |
| 3.5 | NaOH 50 Percent Liquid |

TABLE 2

| Alkaline Solution (Soft Metal Safe) | |
|---|---|
| Weight % | Ingredient |
| 91.6 | Water, Zeolite Softened |
| 1 | Sodium Gluconate Granular |
| 0.5 | Tetrasodium EDTA 40% |
| 4 | Sodium Silicate Solution, 2.40 $SiO_2/Na_2O$ |
| 0.2 | Accusol 448 |
| 2.5 | NaOH 50 Percent Liquid |
| 0.4 | Glucopon 425N |

The high alkaline composition can also include peroxide or sulfite additives in order to enhance cleaning performance. Tables 3-4 illustrate compositions that include sulfite and Tables 5-6 illustrate compositions that include hydrogen peroxide, both of which enhance removal of polymerized zero trans fat soils during cleaning.

TABLE 3

| Alkaline-Sulfite Solution | |
|---|---|
| Weight % | Ingredient |
| 95.4 | Water, Zeolite Softened |
| 0.2 | Tetrasodium EDTA 40% |
| 0.2 | Sodium Gluconate Granular |
| 0.1 | Sodium Silicate Solution, 2.40 $SiO_2/Na_2O$ |
| 0.4 | Glucopon 425N |
| 3.5 | NaOH 50 Percent Liquid |
| 0.2 | Sodium Sulfite |

TABLE 4

| Alkaline-Sulfite Solution (Soft Metal Safe) | |
|---|---|
| Weight % | Ingredient |
| 91.6 | Water, Zeolite Softened |
| 1 | Sodium Gluconate Granular |
| 0.5 | Tetrasodium EDTA 40% |
| 4 | Sodium Silicate Solution, 2.40 $SiO_2/Na_2O$ |
| 2.5 | NaOH 50 Percent Liquid |
| 0.4 | Glucopon 425N |
| 0.2 | Sodium Sulfite |

TABLE 5

| Peroxy-Alkaline Solution | |
|---|---|
| Weight % | Ingredient |
| 95.1 | Water, Zeolite Softened |
| 0.2 | Tetrasodium EDTA 40% |
| 0.2 | Sodium Gluconate Granular |
| 0.1 | Sodium Silicate Solution, 2.40 $SiO_2/Na_2O$ |
| 0.4 | Glucopon 425N |

TABLE 5-continued

| Peroxy-Alkaline Solution | |
|---|---|
| Weight % | Ingredient |
| 3.5 | NaOH 50 Percent Liquid |
| 0.5 | Hydrogen Peroxide 30% |

TABLE 6

| Peroxy-Alkaline Solution (Soft Metal Safe) | |
|---|---|
| Weight % | Ingredient |
| 91.6 | Water, Zeolite Softened |
| 1 | Sodium Gluconate Granular |
| 0.5 | Tetrasodium EDTA 40% |
| 4 | Sodium Silicate Solution, 2.40 $SiO_2/Na_2O$ |
| 2.5 | NaOH 50 Percent Liquid |
| 0.4 | Glucopon 425N |
| 0.5 | Hydrogen Peroxide 30% |

Finally, the high alkaline composition can include a thickener or gelling agent, so that the composition can remain in place on vertical and hanging surfaces for extended time periods without drying out significantly. This extended time period is often critical to cleaning especially tough polymerized zero trans fat soils by providing more time for the cleaning solution to wet through the soil prior to rinsing. Tables 7-8 illustrate compositions that include a thickener which enhances residence time.

TABLE 7

| Gelled Alkaline Solution | |
|---|---|
| Weight % | Ingredient |
| 95.4 | Water, Zeolite Softened |
| 0.2 | Tetrasodium EDTA 40% |
| 0.2 | Sodium Gluconate Granular |
| 0.1 | Sodium Silicate Solution, 2.40 $SiO_2/Na_2O$ |
| 0.4 | Glucopon 425N |
| 3.5 | NaOH 50 Percent Liquid |
| 0.2 | Xanthan Gum |

TABLE 8

| Gelled Alkaline Solution (Soft Metal Safe) | |
|---|---|
| Weight % | Ingredient |
| 91.6 | Water, Zeolite Softened |
| 1 | Sodium Gluconate Granular |
| 0.5 | Tetrasodium EDTA 40% |
| 4 | Sodium Silicate Solution, 2.40 $SiO_2/Na_2O$ |
| 2.5 | NaOH 50 Percent Liquid |
| 0.4 | Glucopon 425N |
| 0.2 | Xanthan Gum |

Methods

This invention is also a method for cleaning polymerized zero trans fat soils by generally using the high alkaline compositions already described above. In certain embodiments, a clean in place (CIP) method is provided. In other embodiments, an environmental cleaning method is provided. Of course, the high alkaline compositions can be used in any other methods seeking to remove polymerized zero trans fat soils.

CIP Method

In one embodiment, a CIP method is provided. This method is adapted for removing polymerized zero trans fat soils from infernal components of tanks, lines, pumps and other process equipment used for processing typically liquid product streams, including zero trams fat streams in addition to external surfaces of such equipment that can be cleaned in an automated fashion in an enclosed area. This method generally involves passing an above-described high alkaline composition through a processing system without dismantling any system components and then resuming normal processing. The high alkaline composition can be used in any known CIP method. In some cases, the method includes passing the following liquids through a processing system: a first rinse, a cleaning cycle using the high alkaline composition herein described: a second rinse and, possibly, a neutralizing or sanitizing rinse and, possibly, a final rinse. The first rinse can include another cleaning composition or hot or cold water. The second rinse often includes hot or cold water and is used to remove the cleaning composition and residual soil. An additional rinse may be used to neutralize or sanitize the equipment being cleaned which may or may not require a final rinse to remove residual neutralizing or final rinse and is often skipped in order to prevent contamination of the equipment with bacteria following the cleaning. In certain cases, the CIP method includes a step of heating the high alkaline composition to a temperature of about 100° F. or above. In various embodiments of the present invention, the method includes a step of heating the high alkaline composition to a temperature of about 100° F. to about 200° F. In still other embodiments of the present invention, the method includes a step of heating the high alkaline composition to a temperature of about 140° F. to about 180° F. The inventors have discovered that high alkaline compositions heated to these temperatures show improved cleaning characteristics of difficult polymerized zero trans fat soils.

The CIP methods can be used to clean a wide variety of processing equipment, including, but not limited to fryers, various freezer or refrigerated systems, evaporators, heat exchangers (including tube-in-tube exchangers, direct steam injection, and plate-in-frame exchangers), heating coils (including steam, flame or heat transfer fluid heated) recrystallizers, pan crystallizers, spray dryers, drum dryers, and tanks. In addition, CIP cleaning methods can be used to clean environmental areas including, but not limited to entire areas containing food processing equipment and associated walls, ceilings, floors in addition to duct work (external and internal) as well as other air handling systems.

The present methods can also be used to remove soils other than polymerized zero trans fat soils. Such other soils include, but are not limited to, starch, cellulosic fiber, protein, simple carbohydrates and combinations of any of these soil types with mineral complexes. Examples of specific food soils that are effectively removed using the present methods include, but are not limited to, soils generated in the manufacture and processing meat, poultry, vegetables and fruit, bakery goods, soft drinks, brewing and fermentation residues, soils generated in sugar beet and cane processing and processed foods containing these ingredients and associated ingredients such as juices, sauces and condiments (e.g., fruit juices, ketchup, tomato sauce, barbeque sauce). These soils can develop on environmental surfaces such as walls and floors, freezers and cooling systems, heat exchange equipment surfaces, conveyor surfaces and on other surfaces during the manufacturing and packaging process.

Exemplary industries in which the present, methods can be used include, but are not limited to: the food and beverage industry; oil processing industry; industrial agriculture and ethanol processing; and the pharmaceutical manufacturing industry.

Environmental Cleaning Method

In another embodiment, an environmental cleaning method is provided. This method is adapted for removing polymerized zero trans fat soils from environmental surfaces, which include, but are not limited to walls, floors, dishes, flatware, pots and pans, ovens and fryers. This method generally involves contacting an environmental surface with an above-described high alkaline composition. In certain cases, the environmental method includes a step of heating the high alkaline composition to a temperature of about 40° F. or above. In various embodiments of the present invention, the method includes a step of cleaning with the high alkaline composition at a temperature of about 40° F. to about 130° F. In other cases the environmental methods provide for soil removal from surfaces at an ambient or room temperature, e.g., about 50° F. to about 100%. In other cases, methods provide tor soil removal from surfaces at colder temperature, e.g., about 25° F. to about 50° F. In other cases, the methods may require applying to environmental surfaces that range in temperature from 0° F. to about 200° F. which may exist in close proximity within a facility to be cleaned (for example freezer coils and hot fat piping respectively). Again, in general, the high alkaline based compositions of the types described tend to show increased beneficial cleaning characteristics with increasing temperature when applied to surfaces contaminated with difficult polymerized zero trans fat soils. The inventors have discovered that the high alkaline compositions do not need to be heated to remove less difficult polymerized zero trans fat soils (soils that have a lower level of polymerization due to less time to polymerize or under lower temperature conditions during polymerization). In some embodiments the environmental method includes contacting an environmental surface with the high alkaline composition for a sufficient amount of time such that the composition penetrates into the soil to be removed. The length of time required for soil penetration will depend on the thickness of the soil as well as the relative polymerization level of the soil. In such cases, it is preferable that the high alkaline composition includes a high foaming surfactant system or a thickening system so that the composition does not dry out and remains hydrated on the surface for an extended period of time.

EXAMPLES

The present invention is more particularly described in the following examples that are intended as illustrations only.

Example 1

Cleaning Efficacy Screening Test

This experiment was run to determine the relative efficacy of cleaning factory produced polymerized zero trans fat soils using exemplary compositions. For this test, a production facility polymerized zero trans fat soil was used.

Production Facility Polymerized Zero Trans Fat Soil Cleaning Test

In this test, brownish red soils from a hood duct that collected zero trans fat mist during frying operations were removed. The soil was then cut into 3 mm sized cubes. This soil was representative of worst case field soils created, by zero trans fat mists over a long period of time (>3 weeks). In addition, reddish-brown soils from a fryer surface were removed and cut into 3 mm sized cubes. This soil was representative of worst case field soils created by zero trans fat polymerized onto hot surfaces over a long period of time (>3 weeks).

Each sample was used in a Production Facility Polymerized Zero Trans Fat Soil Cleaning Test to screen high alkaline-solvent cleaning compositions at room temperature and in a hot water bath set at desired temperatures below 200° F. A sample of one of each soil was placed in a 20 ml vial with 5 ml of a high alkaline-solvent cleaning composition.

Results

Table 9 illustrates the relative efficacy of cleaning factory produced polymerized zero trans fat soils using a basic alkaline-solvent composition, which includes a solvent system and an alkaline system to provide the main cleaning effect at ambient temperatures as well as at elevated temperatures in addition to a surfactant cleaning agent. Table 10 illustrates the same system as Table 9 with the addition of a silicate source to both enhance cleaning and provide some soft metal corrosion protection.

TABLE 9

| Alkaline Solvent | | |
|---|---|---|
| Field Soil Temp | Alk-Sol Dissolution Rating | Alk Dissolution Rating |
| 170 F. | 8 | 4 |
| 72 F. | 7 | 2.5 |

TABLE 10

| Alkaline Solvent (Soft Metal Safe) | | |
|---|---|---|
| Field Soil Temp | Alk-Sol-Sil Dissolution Rating | Alk-Sil Dissolution Rating |
| 170 F. | 2.5 | 2.5 |
| 72 F. | 3 | 2 |

The high alkaline-solvent composition can also include sulfite or peroxide additives in order to enhance cleaning performance. Tables 11 and 12 illustrate the relative efficacy of cleaning factory produced polymerized zero trans fat soils using a sulfite composition and Tables 13 and 14 illustrate compositions that include hydrogen peroxide and a catalyst that permits the alkaline hydrogen peroxide to react with polymerized zero trans fat soils during cleaning.

TABLE 11

| Alkaline-Sulfite Solvent | | |
|---|---|---|
| Field Soil Temp | Alk-Sol Sulfite Dissolution Rating | Alk-Sulfite Dissolution Rating |
| 170 F. | 7 | 5 |
| 72 F. | 7 | 3 |

TABLE 12

| Alkaline-Sulfite Solvent (Soft Metal Safe) | | |
|---|---|---|
| Field Soil Temp | Alk-Sol-Sil Sulfite Dissolution Rating | Alk-Sil Sulfite Dissolution Rating |
| 170 F. | 3 | 3 |
| 72 F. | 3 | 2.5 |

TABLE 13

| Peroxy-Alkaline Solvent | | |
|---|---|---|
| Field Soil Temp | Alk-Sol H2O2 Dissolution Rating | Alk-H2O2 Dissolution Rating |
| 170 F. | 8 | 5 |
| 72 F. | 7.5 | 3.5 |

TABLE 14

| Peroxy-Alkaline Solvent (Soft Metal Safe) | | |
|---|---|---|
| Field Soil Temp | Alk-Sol-Sil H2O2 Dissolution Rating | Alk-Sil H2O2 Dissolution Rating |
| 170 F. | 3 | 3 |
| 72 F. | 2.5 | 2.5 |

Finally, the high alkaline-solvent composition can include a thickener or gelling agent, so that the composition can remain in place on inclined or vertical surfaces for extended time periods without significantly drying out. Tables 15 and 16 illustrate the relative efficacy of cleaning factory produced polymerized zero trans fat soils using a composition that includes a thickener which enhances residence time.

TABLE 15

| Gelled Alkaline Solvent | | |
|---|---|---|
| Field Soil Temp | Alk-Sol Gel Dissolution Rating | Alk-Gel Dissolution Rating |
| 170 F. | 8 | 3.5 |
| 72 F. | 7.5 | 3 |

TABLE 16

| Gelled Alkaline Solvent (Soft Metal Safe) | | |
|---|---|---|
| Field Soil Temp | Alk-Sol-Sil Gel Dissolution Rating | Alk-Sil Gel Dissolution Rating |
| 170 F. | 3 | 3 |
| 72 F. | 2.5 | 2 |

Example 2

Quantitative Cleaning Test

This experiment was run to determine the relative efficacy of cleaning laboratory prepared polymerized zero trans fat soils using exemplary compositions. For this test, a laboratory polymerized zero trans fat soil was created.

Laboratory Polymerized Zero Trans Fat Soil

First, 0.5 g of corn oil was placed on a coupon and then the coupon was heated on a hot plate at 390° F. until the oil became a solid, dark, reddish brown coating. The weight of the soil was determined by subtracting the initial weight of the coupon from the weight of the coupon plus the soil. This soil could be removed by scratching with a fingernail but not with 200% water.

Results

Table 17 illustrates the relative efficacy of laboratory polymerized zero trans fat soils using a basic alkaline-solvent composition, which includes a solvent system and an alkaline system to provide the main cleaning effect at ambient temperatures as well as at elevated temperatures in addition to a surfactant cleaning agent. Table 18 illustrates the same system as Table 9 with the addition of a silicate source to both enhance cleaning and provide some soft metal corrosion protection.

TABLE 17

| Alkaline Solvent | | |
|---|---|---|
| Lab Soil Temp | Alk-Sol % Removal | Alk % Removal |
| 170 F. | 89 | 38 |
| 72 F. | 100 | 26 |

TABLE 18

| Alkaline Solvent (Soft Metal Safe) | | |
|---|---|---|
| Lab Soil Temp | Alk-Sol-Sil % Removal | Alk-Sil % Removal |
| 170 F. | 54 | NA |
| 72 F. | 33 | NA |

The high alkaline-solvent, composition can also include sulfite or peroxide additives in order to enhance cleaning performance. Tables 19 and 20 illustrate the relative efficacy of laboratory polymerized zero trans fat soils using a sulfite composition and Tables 21 and 22 illustrate compositions that include hydrogen peroxide and a catalyst that permits the alkaline hydrogen peroxide to react with polymerized zero trans fat soils during cleaning.

TABLE 19

| Sulfite Solvent | | |
|---|---|---|
| Lab Soil Temp | Alk-Sol Sulfite % Removal | Alk-Sulfite % Removal |
| 170 F. | 77 | 58 |
| 72 F. | 100 | 28 |

TABLE 20

| Sulfite Solvent (Soft Metal Safe) | | |
|---|---|---|
| Lab Soil Temp | Alk-Sol-Sil Sulfite % Removal | Alk-Sil Sulfite % Removal |
| 170 F. | 45 | NA |
| 72 F. | 37 | NA |

TABLE 21

| Peroxy-Alkaline Solvent | | |
|---|---|---|
| Lab Soil Temp | Alk-Sol-H2O2 % Removal | Alk-H2O2 % Removal |
| 170 F. | 77 | 58 |
| 72 F. | 100 | 45 |

TABLE 22

| Peroxy-Alkaline Solvent (Soft Metal Safe) | | |
|---|---|---|
| Lab Soil Temp | Alk-Sol-Sil H2O2 % Removal | Alk-Sil H2O2 % Removal |
| 170 F. | 42 | NA |
| 72 F. | 39 | NA |

Finally, the high alkaline-solvent composition can include a thickener or gelling agent, so that the composition can remain in place on inclined or vertical surfaces for extended time periods without significantly drying out. Tables 23 and 24 illustrate the relative efficacy of laboratory polymerized zero trans fat soils using a composition that includes a thickener which enhances residence time.

TABLE 23

| Gelled Alkaline Solvent | | |
|---|---|---|
| Lab Soil Temp | Alk-Sol-Gel % Removal | Alk-Gel % Removal |
| 170 F. | 77 | 51 |
| 72 F. | 100 | 28 |

TABLE 24

| Gelled Alkaline Solvent (Soft Metal Safe) | | |
|---|---|---|
| Lab Soil Temp | Alk-Sol-Sil Gel % Removal | Alk-Sil Gel % Removal |
| 170 F. | 31 | NA |
| 72 F. | 29 | NA |

It is to be understood that while the invention has been described in conjunction with the detailed description thereof, the foregoing description is intended to illustrate, and not limit the scope of the invention, which is defined by the scope of the appended claims. Other aspects, advantages, and modifications are within the scope of the following claims.

It is to be understood that wherever values and ranges are provided herein, all values and ranges encompassed by these values and ranges, are meant to be encompassed within the scope of the present invention. Moreover, all values that fall within these ranges, as well as the upper or lower limits of a range of values, are also contemplated by the present application.

What is claimed is:

1. A method for removing a polymerized zero trans fat soil from a food processing surface comprising:

(a) diluting a concentrated high alkaline cleaning composition to a use dilution composition, wherein the concentrated high alkaline cleaning composition comprises:

(i) water;

(ii) about 1.5 wt. % to about 30 wt. % of an alkalinity source, wherein the alkalinity source is an alkali metal hydroxide and an alkanol amine;

(iii) about 0.1 wt. % to about 5 wt. % chelating/sequestering agent(s);

(iv) about 0.1 wt. % to about 50 wt. % of a solvent, wherein the solvent comprises an aromatic solvent;

(v) about 0.1 wt. % to about 30 wt. % of a surfactant;

(vi) about 0.01 wt. % to about 5 wt. % of a thickening agent comprising xanthan gum, (b) applying the use dilution composition to the food processing surface at a temperature of between about 40° F. and about 200° F., wherein the food processing surface is soiled with a polymerized zero trans fat soil and one or more of starch, cellulosic fiber, protein, simple carbohydrates, and mineral complexes of the foregoing.

2. The method of claim 1, wherein the concentrated high alkaline cleaning composition further comprises about 1 wt. % to about 10 wt. % surface modifying-threshold agent system comprising an alkali metal silicate, polyacrylic acid, salt thereof, or combination thereof.

3. The method of claim 2, wherein the alkalinity source is sodium hydroxide or potassium hydroxide, and one or more of monoethanolamine, triethanolamine, 2-(2-aminoethoxy) ethanol, and diethanolamine.

4. The method of claim 3, wherein the chelating/sequestering agent(s) is sodium gluconate, an acrylic acid polymer, methacrylic acid polymer, acrylic acid-methacrylic acid copolymer, water-soluble salt of the said polymer, or mixture thereof.

5. The method of claim 4, wherein the surfactant is an alkyl diphenylether disulfonate, a dimethyl alkyl amine oxide, an alkyl polyglycoside, or combination thereof.

6. The method of claim 5, wherein the solvent is benzyl alcohol and one or more of propylene glycol, ethylene glycol phenyl ether, and propylene glycol phenyl ether.

7. The method of claim 2, wherein the surface modifying-threshold agent system comprises sodium silicate and the alkalinity source comprises sodium hydroxide, and wherein the concentrated high alkaline cleaning composition has a greater amount of sodium silicate relative to sodium hydroxide.

8. The method of claim 1, wherein the concentrated high alkaline cleaning composition comprises between about 0.1 wt. % and about 2 wt. % of the thickening agent.

9. The method of claim 1, wherein the method is performed at a temperature between about 40° F. and about 130° F.

10. The method of claim 1, wherein the use dilution composition is a gelled composition.

* * * * *